US005695008A

United States Patent [19]

Bertet et al.

[11] Patent Number: 5,695,008

[45] Date of Patent: Dec. 9, 1997

[54] PREFORM OR MATRIX TUBULAR STRUCTURE FOR CASING A WELL

[75] Inventors: Eric Bertet, Olivet; Jean-Marie Gueguen, Maisons Laffitte; Jean-Louis Saltel; Frédéric Signori, both of Le Rheu, all of France

[73] Assignee: Drillflex, France

[21] Appl. No.: 545,688

[22] PCT Filed: Apr. 28, 1994

[86] PCT No.: PCT/FR94/00484

§ 371 Date: Nov. 3, 1995

§ 102(e) Date: Nov. 3, 1995

[87] PCT Pub. No.: WO94/25655

PCT Pub. Date: Nov. 10, 1994

[30] Foreign Application Priority Data

May 3, 1993 [FR] France ..... 93 05416

[51] Int. Cl.[6] ..... E21B 23/04

[52] U.S. Cl. ..... 166/187; 166/195

[58] Field of Search ..... 166/105, 187, 166/277, 195; 264/323, 570

[56] References Cited

U.S. PATENT DOCUMENTS

| | | | |
|---|---|---|---|
| 4,963,301 | 10/1990 | Davis et al. | 87/1 |
| 5,001,961 | 3/1991 | Spain | 428/542.8 X |
| 5,337,823 | 8/1994 | Nobileau | 166/277 |
| 5,549,947 | 8/1996 | Quigley et al. | 428/36.2 |
| 5,573,039 | 11/1996 | Mang | 138/141 |

*Primary Examiner*—Frank Tsay

*Attorney, Agent, or Firm*—Blakely Sokoloff Taylor & Zafman

[57] ABSTRACT

The tubular structure comprises at least a braid of flexible strands (10) comprising fibers (100) that cross over with a certain amount of play so that the structure is capable of expanding radially while shrinking axially when pressure is applied to the inside of the preform or the matrix.

12 Claims, 5 Drawing Sheets

PREFORM OR MATRIX TUBULAR STRUCTURE FOR CASING A WELL

BACKGROUND OF THE INVENTION

1. Field of the Invention

The present invention relates to a preform or matrix tubular structure for casing a well, in particular a drilled oil well.

In the present description, and in the claims, the term "casing" is used to designate a tube for consolidating a well, the term "preform" is used to designate a tubular structure which is initially flexible and which is subsequently hardened to bond intimately and permanently against the wall of a well (thus constituting a casing), and the term "matrix" is used to designate a structure that is flexible and recoverable, serving as a tool for expanding a preform and pressing it against the wall of the well prior to setting.

The term "production tubing" is used to designate a smaller diameter coaxial tube inside a casing and serving to convey the fluid produced by the well (in particular water or oil).

The tubing is centered and sealed relative to the casing by means of a hydraulically inflatable plug, commonly known as a "packer".

2. Art Background

For casing an oil well, and for similar applications, flexible and settable tubular preforms have already been proposed that are designed to be instaled while in the folded state—a state in which they occupy little radial size—and then to be radially unfolded by applying internal pressure thereto. In that technique, which is described in particular in documents FR-A-2 662 207 and FR-A-2 668 241, the preform, after being radially deployed, possesses a shape that is accurately cylindrical, and of well-determined diameter.

After being installed in a well or in pipework, the wall of the preform is caused to set, e.g. by polymerizing a wall which is composite in structure being made up of a resin impregnating filamentary sleeves. The sleeves ensure the the preform is radially inextensible.

In those techniques, it is necessary to provide for the diameter of the deployed casing to be slightly smaller than the diameter of the hole to be cased so that the wall of the hole does not alter the cylindrical shape of the casing. In general, even if it is very small or even vanishes in places, the annular space that is formed in this way must be filled with cement to complete sealing between the hole and the installed casing.

In addition, while in its folded state, the tubular preform has a radial section that is less than about half its developed radial section, and in most cases that suffices, but in some applications it can be insufficient. That is why, the object of the present invention is to solve the above problem by proposing a preform whose structure is of deformable shape suitable for bearing against the walls of the hole to be cased (or of the casing to be lined) while nevertheless not exceeding certain limits, with deformation being controlled and variable as a function of various applications.

Another object of the invention is to provide a preform whose degree of expansion is considerably greater than that obtained with known devices of the above-specified kind, expansion of the preform taking place in two steps, initially by radial deployment, and subsequently by radial expansion.

SUMMARY OF THE INVENTION

To achieve this result, the invention provides a braided tubular structure which is described below, the structure being equally applicable to a radially-expandable matrix, i.e. to a removable (and reusable) tool serving to expand a preform for the purpose of casing a well, and regardless of whether the preform possesses the structure of the invention.

According to the invention, these results are achieved by the fact that the proposed preform or matrix tubular structure comprises at least one braid of flexible strands made up of fibers that cross over with a certain amount of play so as to enable the structure to expand radially while shrinking axially under the effect of excess pressure being applied inside the preform or the matrix.

In a preferred embodiment, the braiding comprises two series of strands crossing over symmetrically on either side of the generator lines of the tubular structure, i.e. relative to its longitudinal axis, with the strands in each series being mutually parallel.

When the structure is in its radially-contracted state, each of the series of strands preferably lies relative to the longitudinal axis at an acute angle lying in the range 10° to 30°, and preferably about 20°, whereas the same angle lies in the range 50° to 70° when the structure is in its radially-expanded state.

The strands are preferably flat, taking up the shape of tapes.

The tubular preform that also forms subject matter of the invention is remarkable by the fact that it possesses a structure as defined above.

In a preferred embodiment, the preform possesses a wall of composite material, made of a medium that is fluid and settable in which said structure is embedded, the medium being confined between inner and outer skins of elastic material.

The inner skin could be the wall of the matrix itself.

Said material is preferably a settable resin, e.g. a resin that polymerizes when hot.

In a possible embodiment, the outer skin has patterns in relief, e.g. in the form of annular swellings.

Advantageously, the structure comprises a plurality of elementary coaxial tubular structures of the invention, with the various tubular structures being nested one within another with the possibility of mutual sliding.

The structure is preferably sufficiently flexible to be capable of being folded up longitudinally when the structure is in its radially-contracted state.

Thus, if the structure constitutes a preform, while it is being put into place in the well or the pipework, the procedure begins by unfolding it from one end so as to give it a shape that is approximately cylindrical, after which it is subjected to radial expansion by deforming the structure; deployment by unfolding and subsequent expansion is performed by applying a fluid to the inside of the preform.

The invention also provides a tubular matrix having a wall that is flexible and radially expandable, that is designed to press radially against the inside wall of a preform before and during setting thereof for the purpose of casing a well, and in particular an oil well.

The wall of the matrix is provided with at least one tubular structure bonded to an elastic support (likewise tubular, and leakproof) and comprising a braid of flexible strands made up of fibers which cross over with a certain amount of play, such that the structure and its support are capable of expanding together in a radial direction while shrinking in the axial direction under the effect of internal pressure, whereas, conversely, they are capable of shrinking radially and extending axially under the effect of internal suction (vacuum) and/or of axial traction.

In an advantageous embodiment of a matrix of the invention, the tubular structure is inserted between two elastic membranes, an inner membrane and an outer membrane, the assembly forming an inflatable sleeve that is fitted with a tube for feeding fluid into the sleeve.

In an embodiment, such a matrix is fixed to the perform by means of link elements that are easily severed, thereby enabling the matrix to be torn away after casing has been performed, leaving the casing inside the tube or pipework.

Other characteristics and advantages of the invention appear from the description and the accompanying drawings which show preferred embodiments as non-limiting examples.

DETAILED DESCRIPTION OF THE PREFERRED EMBODIMENTS

Figure 1:
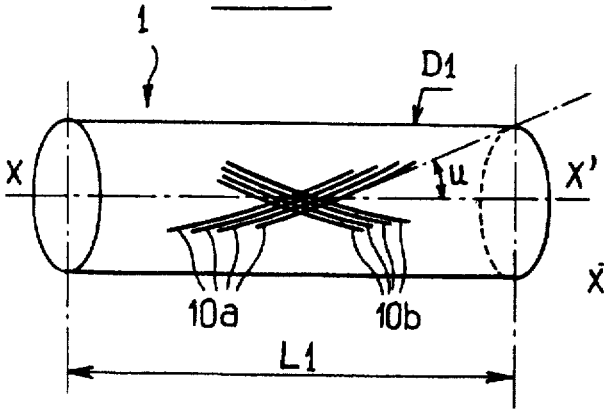
FIGS. 1, 2, and 3 are diagrams showing a preform or a matrix provided with a tubular structure of the invention, the preform or matrix being shown respectively in its radially contracted state, in an intermediate state, and in a radially expanded state.
Figure 2:
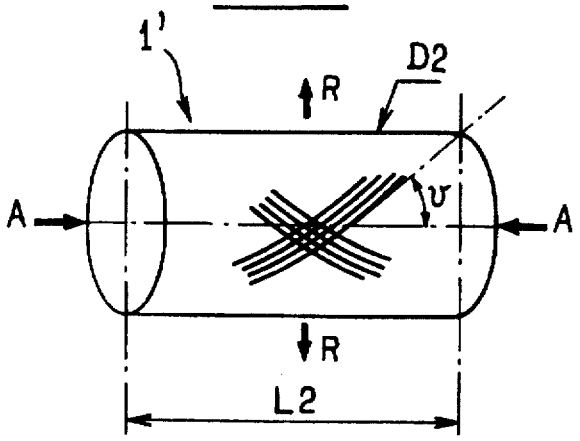
Figure 3:
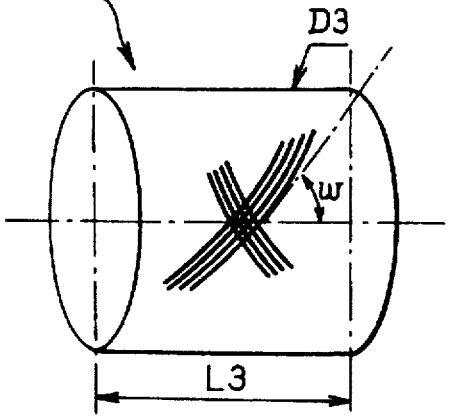

The preform or matrix referenced 1 in FIGS. 1 to 3 is tubular in shape and it has a braided structure. The braid is made up of two series of interwoven flat strands or tapes 10*a*, 10*b* which wind helically to constitute the envelope of the structure. The two series are of opposite pitch, with the strands being inclined at an acute angle u relative to a generator line of the resulting tube, which tube is cylindrical. To simplify the description, FIGS. 1 to 3 use the axis XX' of the tube as a reference. The two series of strands 10*a* and 10*b* are interwoven like the caning of a cane chair, symmetrically about the axis XX' and on either side thereof.

Figure 1A:
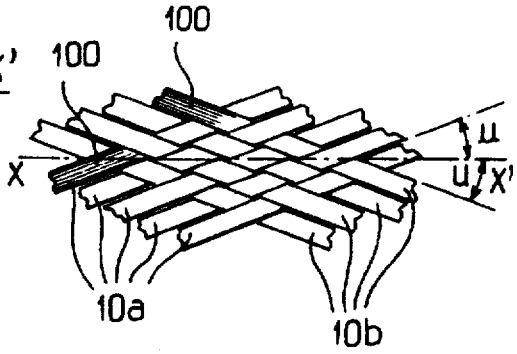
FIGS. 1A, 2A, and 3A are detailed views showing how the flexible strands constituting the structure are braided, while in deformation states corresponding respectively to FIGS. 1, 2, and 3.

Advantageously, the angle u is about 20° (FIGS. 1 and 1A).

Each of the strands 10 is made up of a plurality of fibers or threads that are very strong, and that are placed side by side. They may be glass or carbon fibers having a diameter of a few micrometers, or they may be steel wires.

As an indication, the strands 10 are 1 mm to 6 mm wide for a thickness lying in the range 0.1 mm to 0.5 mm.

The material from which the fibers or threads forming the strands are made preferably has a low coefficient of friction, thereby facilitating mutual sliding between the interwoven strands, and consequently facilitating deformation of the structure.

Figure 2A:
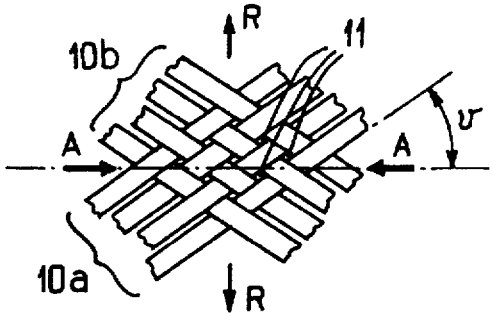

As can be seen in FIG. 2A, the braiding of the two series of strands 10*a* and 10*b* is performed with a certain amount of play, so as to give a loose assembly that leaves gaps 11 in the form of lozenges at the intersections between the two series 10*a* and 10*b*.

FIG. 1 shows a preform or a matrix in the configuration it occupies when its length is at a maximum, L1. In this state, the structure is self-locking, the various strands bearing against one another via their sides. The preform thus has a minimum diameter D1.

It is possible to deform this structure, e.g. by applying internal pressure thereto, as described below.

This phenomenon is shown in FIG. 2. The angle between the strands and the axial direction XX' can be increased, with this deformation causing the above-mentioned gaps 11 to show up. In FIGS. 2 and 2A the two series of strands 10*a* and 10*b* are in an intermediate position with the angle v being about 30° to 35°, for example. This deformation corresponds to axial compression A of the structure and corresponding radial expansion R thereof. The structure thus has a length L2 that is shorter than L1 and a diameter D2 that is greater than D1.

Figure 3A:
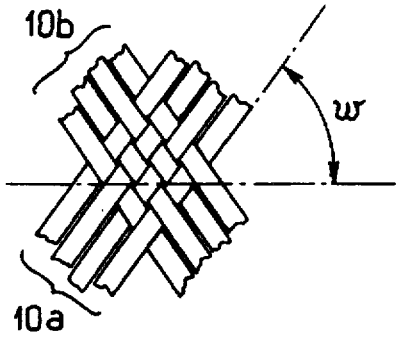

This deformation may continue to the state shown in FIGS. 3 and 3A where the structure is again locked, with the strands making up the braid again bearing against one another as shown in FIG. 3A. The braiding is preferably designed so that this locking effect takes place when the angle w between the strands and the axial direction lies in the range 50° to 70°. The structure then has a minimum length L3 and a maximum diameter D3.

This deformation is naturally reversible, and by pulling axially on the ends of the structure shown in FIG. 3, it is possible to cause it to return to the state shown in FIG. 1.

Figure 8:
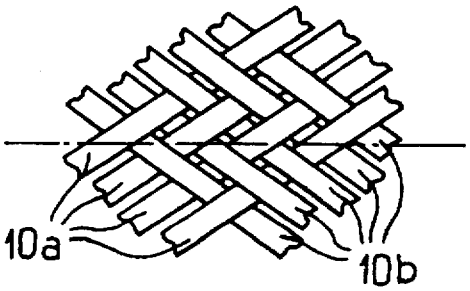
FIG. 8 is a view similar to FIG. 2A showing a variant method of braiding the structure.

The braiding shown in FIGS. 1A to 3A is simple braiding, in which a strand 10*a* passes in alternation over and under a strand 10*b*, and vice versa. Naturally, other forms of braiding could be envisaged, e.g. the braiding shown in FIG. 8. In FIG. 8, each strand 10*a* passes in succession over and under pairs of strands 10*b*, and vice versa.

It is appropriate to recall that the structure shown in FIGS. 1 to 3 is merely diagrammatic, for the purpose of explaining the phenomenon whereby the preform or the matrix is deformable.

Figure 4:
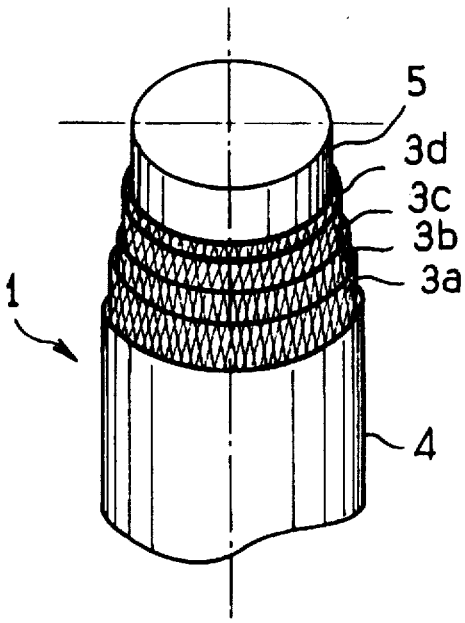
FIG. 4 is a cutaway perspective view of a preform of the invention possessing a plurality of structures engaged within one another.
Figure 5:
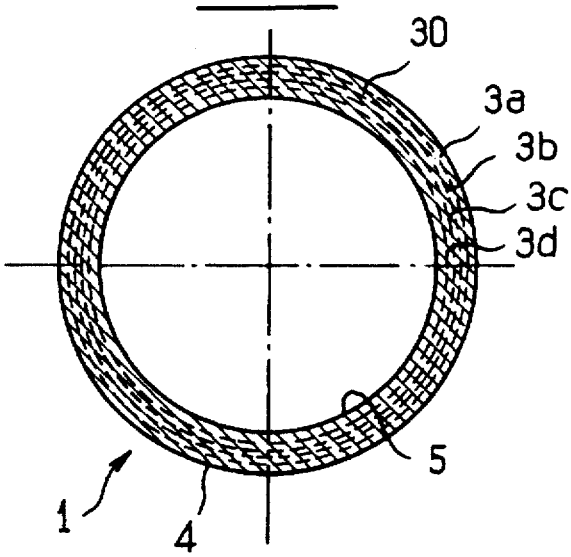
FIG. 5 is a cross-section on a larger scale of the preform of FIG. 4.

FIG. 4 shows a preform 1 susceptible of industrial application. It comprises a plurality of deformable tubular structures of the kind described above, and in particular it comprises four such structures 3*a*, 3*b*, 3*c*, and 3*d* that are coaxial, of ever decreasing diameter, and that are nested one within another. In practice, it is naturally possible to provide a greater number of structures nested one within another, e.g. ten. They are confined between two skins, an outer skin 4 and an inner skin 5, both made of elastic material, e.g. an elastomer material. The role of the inner skin could be played by the wall of the matrix. The tubular structures are impregnated in a medium that is fluid but settable, e.g. a thermosetting resin that polymerizes when hot, which resin is contained between the two skins 4 and 5.

The ability of the skins 4 and 5 to deform is selected to be compatible with that of the braided structures 3, the assembly deforming as a whole, and with the same amplitude throughout.

Figure 6A:
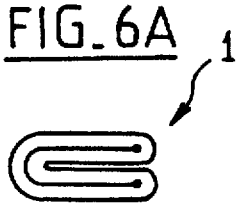
FIGS. 6A and 6B are diagrams showing the section of the preform when axially folded up in two different possible configurations.
Figure 6B:
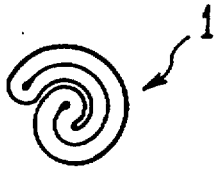
Figure 7:
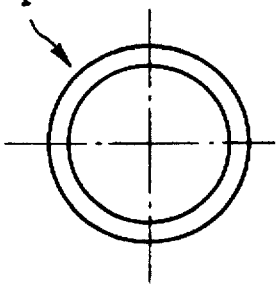
FIGS. 7 and 7' are similar views of one or the other of the preforms of FIGS. 6A or 6B respectively after deployment and after radial expansion.
Figure 7:
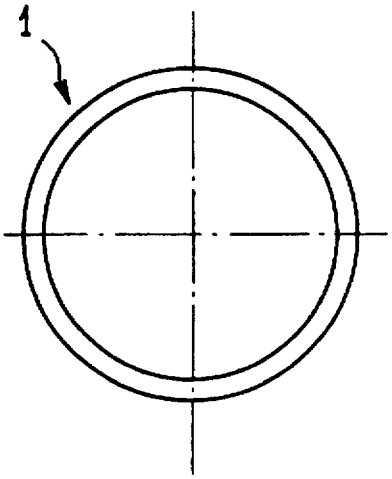

Because the medium 30 is fluid, and because the structures 3*a* to 3*d* are flexible, and capable of sliding freely relative to one another, it is possible to fold up the preform longitudinally. FIGS. 6A and 6B show two possible ways in which it may be folded up (which ways are not limiting), respectively into a U-shape and into a spiral (or snail-shell) shape. After being folded in this way, it is possible to give the preform a cross-section of very small size. By being unfolded, the preform can be deployed to take up the cylindrical shape shown in FIG. 7. Thereafter, e.g. by applying pressure internally, it is possible to cause the preform to expand radially, with each of its concentric structures 3*a*, 3*b*, 3*c*, and 3*d* deforming in application of the above-described phenomenon.

Figure 9A:
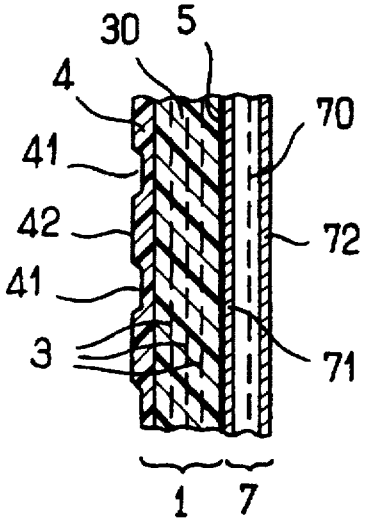
FIG. 9A is a detail on a larger scale of the zone of the wall of the matrix and of the preform that is referenced A in FIG. 9.
Figure 9:
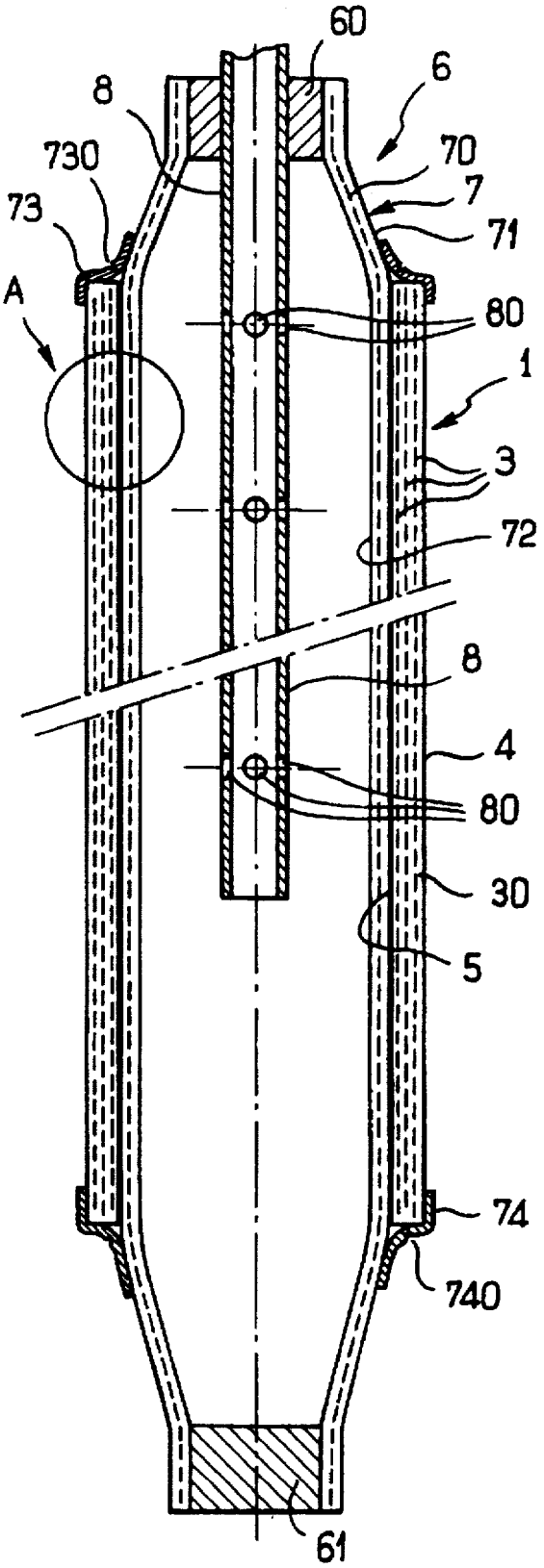
FIG. 9 is a diagrammatic longitudinal section through a matrix and a preform, both in accordance with the invention, while the preform is being installed in a well, the matrix and the preform being deployed but not radially expanded.

FIG. 9 shows a preform similar to that described above and associated with an expander tool designed to put it in place in a well, which tool is referred to be low as a "matrix".

As already stated, the preform 1 which is shown in its unfolded, but not yet expanded state, includes, a medium 30 of thermosetting resin which occupies the annular space between the two skins of elastic material comprising an outer skin 4 and an inner skin 5 or 71 (belonging to the sleeve 7). This gap also contains a plurality of tubular deformable structures that are concentric and made up of braided tapes 3.

The matrix, given reference 6, comprises a tubular sleeve 7 that is closed at its top and bottom ends by respective closure plugs 60 and 61.

The top plug 60 has a tube 8 passing therethrough with openings 80 that open out to the inside of the sleeve 7, as does the free end of the tube 8. Appropriate means (not shown) serve to inject a liquid under pressure via the tube 8 into the sleeve 7 via a flexible duct.

This liquid may be delivered from the surface. In a variant implementation, use may be made of the liquid already present in the well (mud, oil, . . . ) with said liquid being injected into the matrix by means of a pump fitted thereto.

The wall of the sleeve is constituted by two elastic membranes, e.g. made of elastomer material, an inner membrane 72 and an outer membrane 71. Between the two membranes, there is disposed a tubular structure of braided strands of the kind described above and referenced 70. In a variant, a plurality of concentric structures may be provided that are engaged one within another, as is the case for the preform.

The length of the sleeve 7 is greater than the length of the preform 1. End plugs 60 and 61 are fixed, e.g. by adhesive, to the end zones of the inner membrane 72.

The sleeve 7 is fixed, e.g. by means of its outer membrane 71, to the preform 1, by means of end cuffs 73 and 74. These have severing zones 730 and 740, respectively. The cuffs 73 and 74 form gaskets between the preform and the sleeve 7 constituting the matrix 6.

The interface between the outer membrane 71 of the sleeve and the inner skin 5 of the preform is treated so as to ensure that there is little adhesion between them, e.g. by being coated in a silicone.

In an embodiment, the inner skin may be omitted.

Preferably, as can be seen in the detail of FIG. 9A, the outside face of the outer skin 4 of the preform has pads 40. The pads may be constituted, for example, by annular swellings separated by grooves 41 that are likewise annular. The purpose of the pads is to improve sealing with the wall of the well, and to retain prestress and a degree of flexibility after setting.

Figure 10:
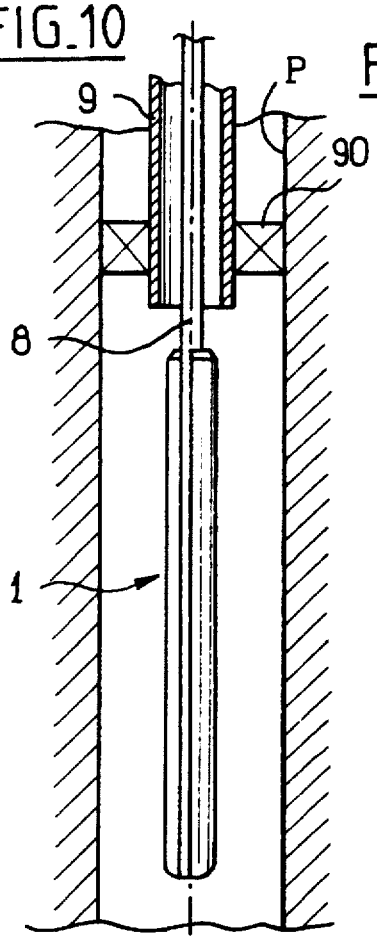
FIGS. 10, 10A, 10B, 10C, and 10D are diagrammatic views for showing the various successive steps in installing casing in an oil well via its production tubing, and using a matrix and preform assembly as shown in FIG. 9.

FIG. 10 and the following figures show how an oil well can be cased via its production tubing by means of the preform 1 and with the help of a matrix as described above.

Reference P designates the wall of the well, and reference 9 designates the production tubing installed in the well, the tubing being held and centered by a hydraulic plug or "packer" 90.

As an indication, the inside diameter of the tubing 90 is 60 mm whereas the mean diameter of the well is about 180 mm. The preform is inserted while folded up, e.g. in snail configuration (see FIG. 6B), so that the greatest dimension of its cross-section is less than the inside diameter of the tubing 9. This greatest dimension may be about 55 mm, for example. The preform is thus lowered together with the tube 9 down to the desired level inside the well. Initially, the preform 1 is caused to be deployed so as to take up a cylindrical shape. Its outside diameter is then 90 mm. This is achieved by injecting a fluid such as water under pressure into the sleeve 7, via the tube 8.

Figure 10A:
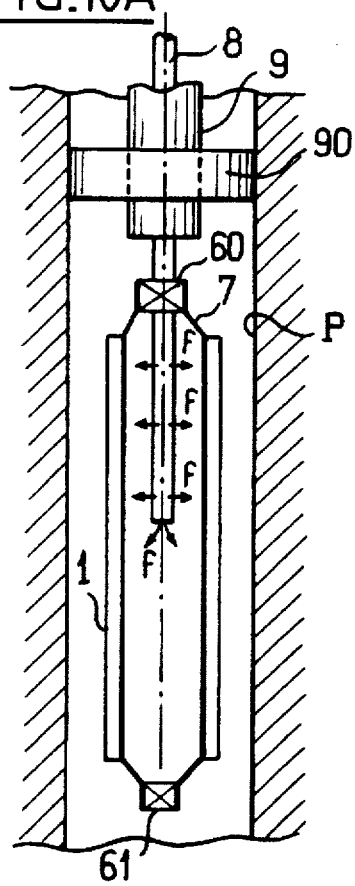

This fluid delivery is represented by arrows f in FIG. 10A.

Figure 10B:
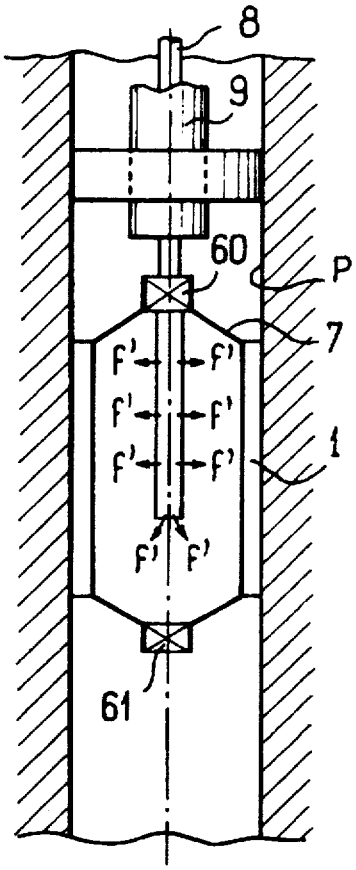

Thereafter the pressure of the fluid is increased, as represented by arrows f' in FIG. 10B. This achieves radial expansion both of the sleeve 7 and of the preform 1, with the braiding being deformed in the manner described with reference to FIGS. 1 to 3.

Naturally, while this radial expansion is taking place, the length of the preform and of the matrix decreases. The preform thus expands to a diameter of 180 mm.

The preform is thus pressed intimately against the wall P of the well. The amount of expansion that takes place depends on requirements, i.e. it is a function of the projections from the wall. This constitutes an essential difference relative to known flexible preform devices in which radial expansion cannot take place beyond a well-defined diameter. The preform therefore adapts to the shape of the well as it finds it. This is made easier by the presence of the pads 40 which serve to provide anchoring and sealing.

Figure 10C:
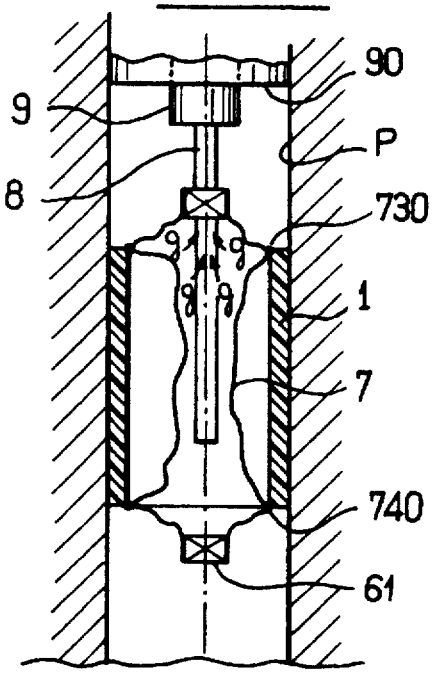
Figure 10D:
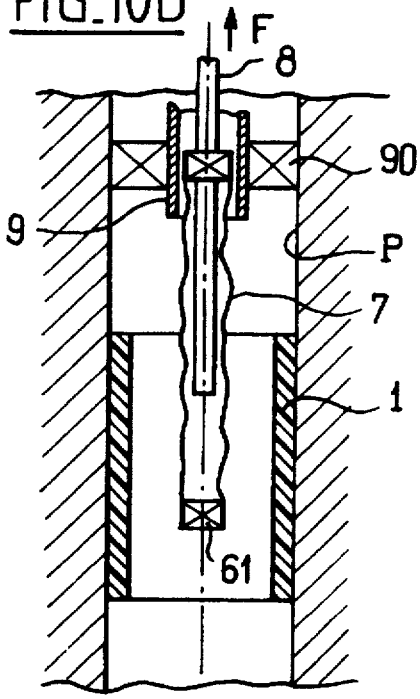

Thereafter, the wall of the preform is allowed to set by injecting a hot fluid (under pressure) into the sleeve 7 and causing it to circulate. Once polymerization has terminated, the fluid contained in the sleeve is sucked out, thereby causing the sleeve to shrink radially, as shown in FIG. 10C.

By applying upward traction on the tube 8, it is then possible to tear the entire matrix away by breaking its severable connection zones 730 and 740.

The sleeve 7 lengthens by shrinking radially, and it can be extracted through the tubing 9.

Once set, the original preform 1 constitutes part of the casing of the well.

Such casing can be used with or without cement, depending on the ground conditions involved.

When the preform is put into place in the well, it is naturally necessary to take account of the way in which its axial length is going to shorten during the operation.

Figure 11:
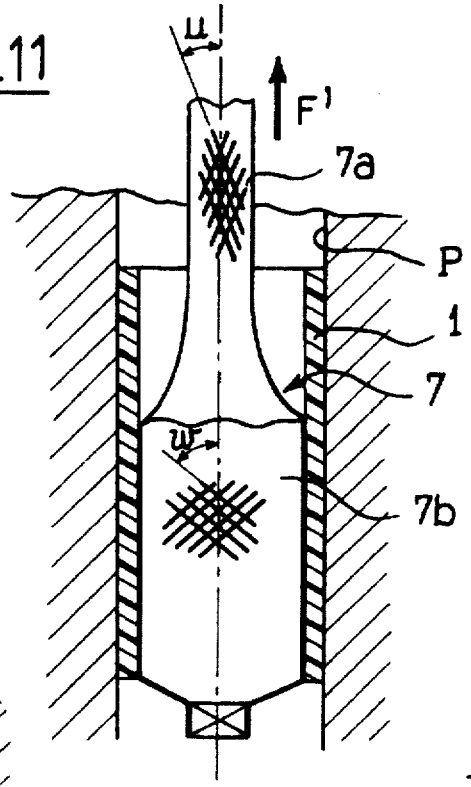
FIG. 11 shows one possible way of extracting the matrix.

The method of extraction shown in FIG. 11 does not require suction to be applied to the inside of the matrix.

Because the structure is braided, by applying traction F' to the matrix, it shrinks progressively in a radial direction, the shrinking moving downwards, thereby separating it from the casing 1 (that has already set).

Reference 7*a* designates the already-shrunk portion of the matrix, that has become detached from the casing, with the strands of the structure crossing at the angle u.

Reference 7*b* designates the expanded portion whose strands cross at the angle w.

Figure 12:
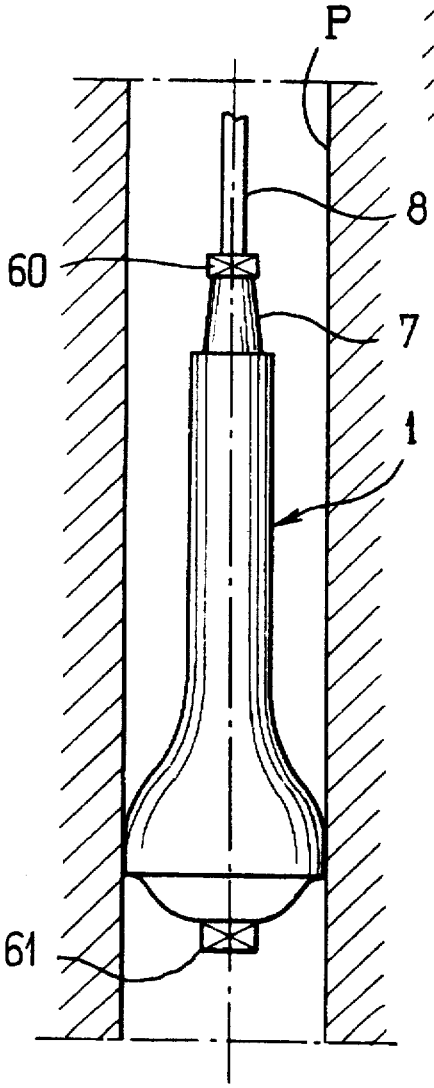
FIGS. 12 and 12A show progressive inflation of a matrix during the expansion of a preform in a well.
Figure 12A:
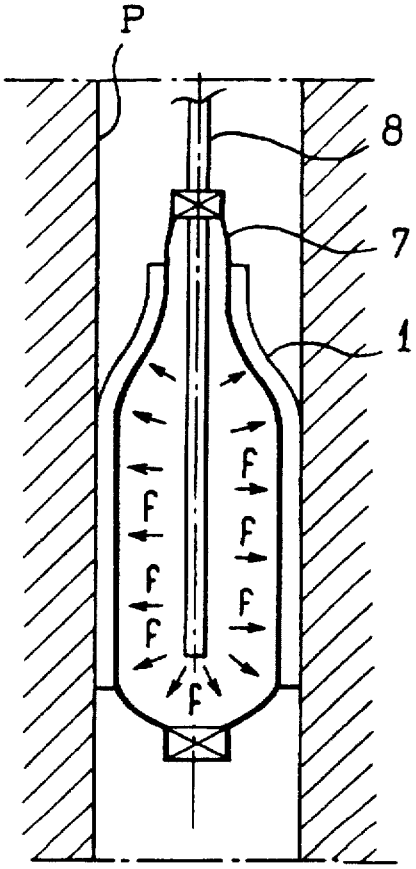

FIGS. 12 and 12A show the matrix 7 and the preform 1 being expanded progressively from the bottom upwards with an inflation liquid being injected via the duct 8 into the bottom portion of the matrix. Such progressive inflation can be obtained, for example, by enclosing the preform and the matrix (in the folded state) in an envelope that is suitable for being torn longitudinally in an upwards direction.

Naturally, the braided deformable structure of the invention can be implemented with preforms that are installed without making use of inflatable matrices that themselves make use of said structure, and vice versa.

In a possible embodiment of the structure, some of the fibers in at least some of the strands (and advantageously in all of the strands) are replaced by electrically-conductive wires enabling the preform or the matrix to be heated for the purpose of polymerizing the preform, by connecting the wires to an electricity supply.

This is particularly advantageous for a (reusable) matrix where providing electrical connections to the two ends of the structure is not particularly difficult.

We claim:

1. An assembly comprising a radially expandable tubular preform for casing a well and a recoverable matrix serving as a tool for expanding the preform, wherein a) said preform possesses an inside and a wall of composite material formed by a resin that is fluid and settable, said resin confined between an inner skin and an outer skin of elastic material, within which there is embedded a tubular structure of flexible strands crossing over one another, enabling it to expand radially while shrinking axially under the effect of pressure being applied to the inside of the preform; and b) said matrix initially secured to the preform includes an inflatable sleeve inside the preform into which it is possible to inject a fluid under pressure in such a manner as to press the matrix radially against the inside wall of the preform causing both the sleeve and the preform to expand radially, said matrix being suitable for being torn off at the end of the operation after the preform has set.

2. An assembly according to claim 1, wherein said tubular structure of said preform comprises:

a braid of flexible strands made up of fibers and includes two series of strands that cross over one another symmetrically relative to a longitudinal axis of the tubular structure, the strands in each series being parallel to one another.

3. An assembly according to claim 2, wherein said preform is in its radially contracted state, each of said series of strands forms an acute angle lying in a range 10° to 30° and preferably about 20° relative to the longitudinal axis.

4. An assembly according to claim 2 or 3, wherein said preform is in its radially expanded state, each of said series of strands forms an acute angle lying in a range 50° to 70° relative to the longitudinal axis.

5. An assembly according to claim 2, wherein said strands are flat, taking a form of tapes.

6. An assembly according to claim 2, wherein said preform possesses a plurality of braided strand structures engaged coaxially within one another.

7. An assembly according to claim 1, wherein said preform is sufficiently flexible to be capable of being folded up longitudinally when it is in its radially contracted state.

8. An assembly according to claim 1, wherein said outer skin of the preform possesses patterns in relief.

9. An assembly according to claim 1, wherein said inflatable sleeve is fitted with a tube for feeding fluid inside of the sleeve.

10. An assembly according to claim 1, wherein said matrix is fixed to the preform by severable link elements.

11. An assembly according to claim 1, wherein said sleeve also possessing a tubular structure made up of flexible strands crossing over one another.

12. An assembly according to claim 11, wherein at least one of the strands of the sleeve is replaced by electrically conductive wire enabling the preform to be heated for polymerization purposes, when said wire is connected to a source of electrical current.

* * * * *

UNITED STATES PATENT AND TRADEMARK OFFICE

CERTIFICATE OF CORRECTION

PATENT NO. : 5,695,008

DATED : December 9, 1997

INVENTOR(S) : Bertet, et al.

It is certified that error appears in the above-identified patent and that said Letters Patent is hereby corrected as shown below:

In column 3, line 65, and in column 4, line 4, delete "angle u" and insert -- angle u --.

In column 4, line 33, delete "angle v" and insert -- angle v --.

In column 4, line 44, delete "angle w" and insert -- angle w --.

In column 6, line 32, delete "arrows f" and insert -- arrows f --.

In column 6, line 34, delete "arrows f'" and insert -- arrows f' --.

In column 7, line 9, delete "angle u" and insert -- angle u --.

Signed and Sealed this

Sixth Day of June, 2000

*Attest:*

Q. TODD DICKINSON

*Attesting Officer*

*Director of Patents and Trademarks*